US008083276B2

(12) United States Patent
Schopp

(10) Patent No.: US 8,083,276 B2
(45) Date of Patent: Dec. 27, 2011

(54) APPARATUS FOR HANGING A STRING OF LIGHTS

(76) Inventor: William R. Schopp, Los Angeles, CA (US)

( * ) Notice: Subject to any disclaimer, the term of this patent is extended or adjusted under 35 U.S.C. 154(b) by 1058 days.

(21) Appl. No.: 11/899,666

(22) Filed: Sep. 7, 2007

(65) Prior Publication Data

US 2008/0061571 A1 Mar. 13, 2008

Related U.S. Application Data

(60) Provisional application No. 60/842,824, filed on Sep. 8, 2006.

(51) Int. Cl.
*A47F 13/06* (2006.01)

(52) U.S. Cl. ..... 294/24; 294/19.1; 7/167; 29/271; 29/280; 29/281; 29/242; 29/243

(58) Field of Classification Search ..... 294/19.1, 294/22, 23, 24, 92; 7/127, 138, 139, 166, 7/167; 29/271, 280, 281, 242, 243; 81/53.1, 81/53.11, 53.12; 16/429; 403/292, 299, 403/300, 302, 309, 311, 313, 387, 361, 165
See application file for complete search history.

(56) References Cited

U.S. PATENT DOCUMENTS 3,936,088 A 2/1976 Williams
4,153,286 A 5/1979 Piper et al.
4,163,576 A 8/1979 Hoop
4,469,361 A 9/1984 Pendergraft
4,714,219 A 12/1987 Mayse
5,012,624 A * 5/1991 Dahlgren ..... 52/506.06
5,553,905 A * 9/1996 Bentivegna ..... 294/24
5,560,975 A 10/1996 Casper
5,566,058 A 10/1996 Protz, Jr.
5,575,446 A 11/1996 Swenson et al.
5,575,470 A * 11/1996 Sherman ..... 473/489
5,624,180 A 4/1997 Lanning
5,669,709 A 9/1997 Adams
5,809,850 A * 9/1998 Tickner ..... 81/53.11
5,809,857 A * 9/1998 Owen ..... 83/404.1
5,813,751 A 9/1998 Shaffer
5,868,334 A 2/1999 Cedillo
5,964,489 A 10/1999 Mahoney
6,290,372 B1 9/2001 Mack
6,352,291 B1 3/2002 Tortajada
6,425,614 B1 7/2002 Limber et al.
6,487,765 B1 * 12/2002 Brekken ..... 29/428
6,827,379 B2 12/2004 Hill et al.
(Continued)

*Primary Examiner* — Saul Rodriguez
*Assistant Examiner* — Stephen Vu

(57) ABSTRACT

A small plastic tool is configured with a socket that may be screwed onto the end of a conventional broomstick, mop handle, paint roller extension pole, or other long pole to allow the tool to be raised to an elevated height while the user remains standing on the ground surface. The tool has a distal end formed with cruciform arms. A hook receiving slot is defined into the structure of a first mutually opposing pair of the cruciform arms, while a wider channel is defined through the other pair of cruciform arms. The hook receiving slot is configured to snugly receive the hook portion of a cup hook, which allows the cup hook to be raised to overhead, elevated, horizontal surfaces. The pole can then be rotated to screw the threaded shank of the cup hook into the overhead structure. The same tool can be used to cradle the twisted pair of wires of a string of lights in the channel defined in the distal end of the other pair of cruciform arms in the tool. The string of lights can thereby be lifted, supported within the channel and deposited in the crook of the hook portion of the cup hook.

14 Claims, 5 Drawing Sheets

U.S. PATENT DOCUMENTS 7,100,238 B2 * 9/2006 McCauley ..... 16/110.1
7,334,825 B1 * 2/2008 Sammon ..... 294/24
7,429,067 B1 * 9/2008 Rosa ..... 294/19.1

* cited by examiner

APPARATUS FOR HANGING A STRING OF LIGHTS

CROSS-REFERENCES TO RELATED APPLICATIONS

This patent application claims the benefit of U.S. Provisional Patent Application Ser. No. 60/842,824 filed Sep. 8, 2006 for Method and Apparatus for Hanging Strings of Lights, which application is incorporated here by this reference.

TECHNICAL FIELD

This invention relates to a device that facilitates the installation of hooks and the hanging of light strings, such as strings of Christmas lights, from those hooks on the eaves of a roof or some other elevated structure. The invention also relates to the method of utilizing such a device.

BACKGROUND ART

It is the custom and practice in many different countries of the world to decorate elevated structures, such as the eaves of buildings, with strings of decorative lights. Such light strings are comprised of a multiplicity of small bulbs, usually no greater than an inch in length, connected to each other at intervals of typically one to two feet by intertwined, twisted, insulated electrical wires. Each light string ends in a plug that may be plugged into either a socket of an adjacent light string, or into a conventional electrical outlet inside or outside the building upon which the strings of lights are installed.

In conventional practice the light strings are usually positioned by propping a ladder against the structure and climbing up the ladder to approximately the level at which the strings of lights are to be hung. The user then screws hooks, such as standard cup hooks, into the building structure, either on the inside or outside of the fascia board of an eave of a roof, or into the side of the structure above a line of windows to be decorated. Alternatively, the user may utilize wire brads or even nails to support the light strings.

Cup hooks are small structures that derive their name from use for hanging drinking cups by the cup handles from the undersides of kitchen or pantry shelves. Each cup hook has a generally C-shaped hook that terminates in a shank that projects away from the hook. The end of the shank is typically threaded with a tapered wood screw thread. Most cup hooks include some sort of flange at the transition between the hook portion and shank portion of the cup hook to limit the extent to which the threaded distal tip of the shank can be screwed into some structure, usually a wood structure. For reference purposes herein the shank end of the transition between the shank and the hook portion is considered to be the "hook shoulder" end of the shank, while the opposite pointed tip is considered to be the "distal" end of the shank.

The flange may be as small as merely an enlarged bead at the hook shoulder end of the shank, or it may be a concave, spherical arcuate segment shoulder guard, the circular edge of which bears against the building eave or fascia board when the cup hook is screwed into position.

The cup hook is installed by pressing the pointed, distal, threaded tip of the shank against a fascia board or eave and rotating the structure of the cup hook using its hook portion as a handle so that the threaded shank will penetrate into the wood. Rotation of the cup hook is continued until the threaded shank of the cup hook is securely anchored in the wooden structure of the roof eave or fascia board. The insulated wires of the light string are then laid into the hook portion of the cup hook.

In conventional practice it is not only necessary for an individual installing light strings to climb up a ladder for the purpose of installing the cup hooks and laying the wire into the hooks, but also to ascend and descend the ladder many times, repositioning it every few feet. The installer must climb up and down the ladder many times in order to install a sufficient number of cup hooks lengthwise along the elevated structure to be decorated.

The necessary ascent and descent and repositioning of a ladder to install strings of lights on elevated structures in a conventional manner is not only time consuming, laborious, and tiring, but also dangerous. Many people are simply unsteady on ladders and can fall. Others risk falling by attempting to reach too far to the side in order to avoid having to reposition a ladder or because the ladder cannot be positioned at a desired location due to the presence of a window or some other structure that will not support the force of the ladder leaning against it.

Other individuals will sometimes go out on top of a roof and lean over the edge in order to install strings of lights. This is also a dangerous practice, and in any event practical only when the roof is flat.

Despite the time and energy required to install strings of decorative lights, and despite the physical danger of falling incident thereto, the pleasure and gratification that results from the decorative effective effect achieved from hanging strings of illuminated lights at elevated levels is a very common practice. The hanging of strings of lights is often performed in this country during the holiday season of Christmas, and is also practiced to a considerable extent even in the absence of any holiday celebration. Nevertheless, as presently practiced, the hanging of strings of decorative lights is a practice that is laborious, physically demanding, time consuming, and physically dangerous.

DISCLOSURE OF INVENTION

The present invention is a method and apparatus that greatly facilitates the hanging of both cup hooks and decorative light strings from those cup hooks on elevated structures. According to the present invention a small installation tool is provided which can be screwed onto the end of a standard broomstick or other pole, such as a paint roller extension pole, having a threaded tip. The tool is a small, light weight, generally cylindrical structure, preferably only about two inches in length and about one inch in external diameter. The installation tool has a proximal end with an internally threaded socket defined therein that has a size and pitch that receives the standard externally threaded tip of a broomstick or other pole having a threaded end.

The distal end of the tool is preferably shaped as a generally cruciform tip that has a narrow, elongated slot defined in two mutually opposing arms. The slot has a width, length, and depth of size just sufficient to receive the hook portion of a cup hook. Preferably, the slot has a narrow, elongated, rectangular opening and the bottom of the slot is rounded so as to conform to the rounded shape of the hook portion of a standard three quarter inch cup hook.

The other pair of mutually opposing arms of the cruciform tip have a longitudinal channel defined therein that is oriented perpendicular to the slot for the cup hook. This channel passes through the upper, distal, open extremity of the hook receiving slot of the cup hook. The channel is of a width just sufficient to receive the twisted insulated wires of the light string to be installed.

Preferably also, the center of the distal, cruciform tip is chamfered slightly where the channel intersects the hook receiving slot. Chamfering of the cruciform arms at the intersection between the channel and the slot allows the tip of the tool to better accommodate the convex face of a rounded cup hook shoulder flange.

The tool also is preferably configured with indicia on its external side surface that is visible to a person standing on the ground holding the tool aloft. The indicia allow the user to ascertain the angular orientation of the tool relative to either a cup hook or a light string. The indicia are particularly useful for the purpose of informing the person installing the cup hooks and the lights the orientation of the tool relative to the hook portion of a cup hook and relative to the intertwined, twisted, insulated wires of a light string. These indicia serve as visual aides since the hook receiving slot and the wire receiving channel on the tip of the tool are not visible to the user when the tool is raised to install or remove the cup hooks or a string of lights.

The tool of the invention is preferably a small, generally cylindrical apparatus which has dual functions. The first purpose for which the tool is designed is to install and remove cup hooks at elevated locations, such as under the eaves of a building or on the fascia board of a building. By mounting the tool of the invention on the threaded end of a broomstick or other pole having male threads thereon, a user is able to remain standing on the ground surface and still reach the elevated location at which the cup hooks are to be installed since the broomstick or other pole has the length necessary to reach up to the desired elevation. The use of the tool of the invention allows cup hooks to be installed and strings of lights to be hung on the hook portions of the cup hooks without ever using a ladder.

To utilize the tool to install a cup hook, the user lowers the threaded tip of the broomstick or paint roller extension pole and screws the socket of the tool onto the externally threaded broomstick or extension pole tip. The user then grips a cup hook by its shank and places the hook portion of the cup hook into the hook receiving slot at the distal extremity of the tool. The hook receiving slot has a size and shape that snugly, but releaseably, accommodates the hook portion of a cup hook and orients the cup hook so that the threaded distal tip of the cup hook shank projects in general longitudinal alignment with the axis of both the tool and the broomstick or other pole upon which the tool is mounted.

Once the cup hook is in position with its threaded shank extending longitudinally out from the end of the threaded broomstick or pole, the pole is raised with the hook portion of the cup hook nested into the hook receiving slot of the tool and the threaded distal tip of the shank projecting therefrom. The pole is raised until the tool resides closely beneath the elevated structure into which the cup hook is to be installed. This structure may be the lower, horizontal surface of a building box eave, or the lower, horizontally located edge of a vertical fascia board. In either case the pole is pushed upwardly until the threaded, distal tip of the cup hook shank is pressed against a downwardly facing, elevated, horizontal surface to which the cup hook is to be attached. With light upward pressure the installer then rotates the broomstick or pole about its own axis, thereby advancing the threaded tip of the cup hook into the elevated supporting structure from which the string of lights is to be hung. The tool of the invention thereby functions in the nature of a screwdriver for installing the cup hook.

Once the threaded tip of the cup hook shank has been advanced upwardly into the horizontal structure from which the cup hook is to depend, the broomstick or pole is then retracted vertically downward from the cup hook. Because the shank of the cup hook is firmly engaged in an elevated, horizontal wood surface, the hook will slide easily out of the hook receiving slot so that the tool can be easily drawn away from the hook portion of the cup hook. Preferably, the hook portion of the cup hook is left oriented so that the opening in the C-shaped portion of the cup hook is directed in a generally upward direction facing outwardly from the building. This facilitates laying the twisted wires of the light string into the crook of the hook of the cup hook.

The user continues to install a series of cup hooks in this fashion at longitudinally spaced intervals of between one and three feet or more without ever needing the aid of a ladder. The user simply walks the required distance to the location directly beneath the position at which the next cup hook is to be installed, and repeats the cup hook installation procedure. Because it is unnecessary to ascend and descend a ladder, or to reposition a ladder, the installation of all of the cup hooks proceeds much more rapidly than is currently possible.

Once the user has installed downwardly depending cup hooks along the desired, linear path, the same tool of the invention can be used to suspend the string of lights from the depending cup hooks. To install the light string, the user simply lowers the pole and orients it so that the insulated, intertwined electrical wires providing power to the bulbs in the light string is oriented in alignment with the light string receiving channel in the distal top of the tool. The user then raises the pole to lift the string of lights upwardly, past the upwardly and outwardly facing opening of the hook portion of the cup hook. The user then manipulates the pole to move the light string laterally into the hook opening of the cup hook, and then lowers the broomstick or other pole. As the extension pole is drawn away from the light string, it leaves the twisted pair of electrical wires resting in the crook portions of the depending cup hooks.

The strings of lights which may be so easily installed using the tool of the invention are just as easily uninstalled utilizing the same tool. To take down a string of lights the user merely positions the light string receiving channel at the distal tip of the tool in alignment and directly beneath the electrical wires of the light string between two adjacent bulbs near a cup hook. The user then lifts the light string slightly at this location and moves the tip of the extension pole bearing the tool of the invention laterally slightly, thereby disengaging the twisted pair of insulated wires from the adjacent hook. The user continues to take the light string down from each hook in this fashion until the last portion of the light string has been removed from the last cup hook.

Although not always necessary or desirable, the cup hooks can likewise be easily removed, as well as installed, utilizing the tool of the invention. To remove the cup hook the user merely positions the hook receiving slot at the distal tip of the tool in alignment with the depending hook portion of the cup hook and raises the broomstick upwardly so that the hook portion of the cup hook again resides within the lateral confines of the hook receiving slot. The user then rotates the pole about its own axis, this time in a direction to unscrew the threaded tip of the shank of the cup hook from the elevated structure. Once the entire length of the shank of the cup hook has been unscrewed from the elevated, horizontal structure, the hook portion of the cup hook will remain within the confines of the hook receiving slot in the tip of the tool. The broomstick or extension pole can then be lowered to the ground and the cup hook, which has been detached from the elevated structure to which it was previously attached, is removed from the tool.

In one broad aspect the present invention may be considered to be a tool having proximal and distal ends. A socket is defined in the proximal end of the tool having a size and thread pitch suitable for receiving a conventional externally threaded end of a broomstick, mop handle, paint roller extension pole, or other thin, elongated pole-like structure having a threaded tip. The opposite, distal end of the tool is configured with a slot shaped to receive the hook portion of a cup hook and a channel extending transversely across the width of the tool and having a size and shape suitable for receiving twisted wires at locations between the bulbs of a string of lights. While the channel can be aligned with the elongated slot, preferably it is oriented at right angles relative thereto so that the tool when positioned in one angular orientation is adapted to receive the hook portion of a cup hook within the hook receiving slot, and when rotated about its axis ninety degrees, disoriented to receive a pair of twisted wires between bulbs of a string of lights within the channel.

Preferably, the elongated hook receiving slot and the light string wire receiving channel are oriented at right angles to each other in mutually opposing sets of arms on the distal tip of the tool. The tool is also preferably provided with visual indicia on its exterior side surface so that the orientation of the distal tip of the tool can be visually ascertained by the user on the ground. That is, one indicia is preferably oriented in alignment with the cruciform arms into which the elongated hook portion receiving slot is defined, while the other indicia is aligned with the other set of arms of the cruciform structure into which the light string wire receiving channel is formed. The invention may be described with greater clarity and particularity by reference to the accompanying drawings.

BEST MODE FOR CARRYING OUT THE INVENTION

Figure 1:
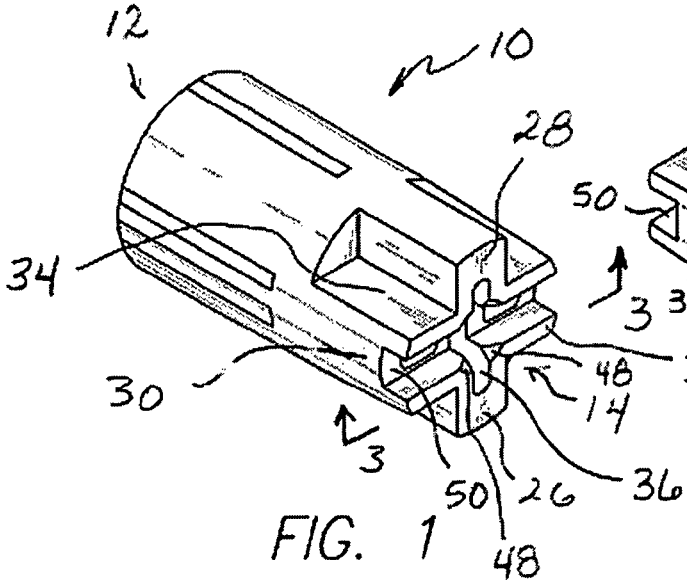
FIG. 1 is a perspective view of the tool of the invention as viewed from the distal end thereof.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

As illustrated in FIGS. 1-5 and 7, a light string installation and removal tool 10 is formed as a small, molded hard plastic, generally cylindrical structure having length of about one and seven-eighths inches and an external diameter of about one inch. More specifically, the tool 10 preferably has an overall length from the extremity of its proximal end 12 to the extremity of its distal end 14 of about 1.9 inches and an external diameter of about 0.969 inches. This external diameter is large enough to define an internal threaded socket 16 in the proximal end 12 of the tool 10. The proximal end 12 of the tool 10 maybe considered to be its passive end, while the distal end 14 thereof may be considered to be its working end.

The tool 10 is utilized to install both a set of cup hooks 40 and also a string of decorative lights 60. The cup hooks 40 may be standard three-quarter inch cup hooks each with a three-eighths inch diameter base 46. The decorative string of lights 60 may be a standard string of twenty-five, fifty, or one hundred Christmas lights.

The small size of the tool 10 ensures that it is lightweight enough so that it may be repetitively hoisted upwardly without unduly tiring the person performing the installation or removal of the light string 60 and cup hooks 40. Indeed, the strength and energy requirements in this regard are far less than would be required to position a ladder, ascend it, and install the cup hooks 40 and light strings 60 using a ladder.

The plastic used to fabricate the tool 10 may be hard, polyvinyl chloride plastic. The tool 10 should be hard enough so that even with multiple installations of cup hooks, it will not crack, scar, or break. Preferably the tool 10 is configured with friction points so that it may be used with or without an extension pole 22.

The proximal end 12 of the tool is preferably about 1.125 inches in length. The proximal end 12 of the tool 10 defines within its structure a socket 16 with internal, female threads that threadably engage the externally threaded end 20 of a conventional broomstick or paint roller extension pole 22. More specifically, the socket 16 is formed with a nominal, internal pitch diameter of 0.634 inches at the peaks of the internal threads defined in the proximal end 12, and with a diameter of 0.739 inches at the valleys between the peaks. The internal threads 24 are formed with an angular, obtuse angle incline of 119.74 degrees and with a longitudinal pitch of 0.20 inches from one of the thread teeth 24 to the next. The configuration of the internally threaded socket 16 is thereby such that it can be readily screwed onto and will remain affixed to the externally threaded tip 20 of a conventional broomstick 22. The internal female threads 24 of the socket 16 firmly, but releaseably, engage the external male threads 21 on the broomstick 22.

Figure 4:
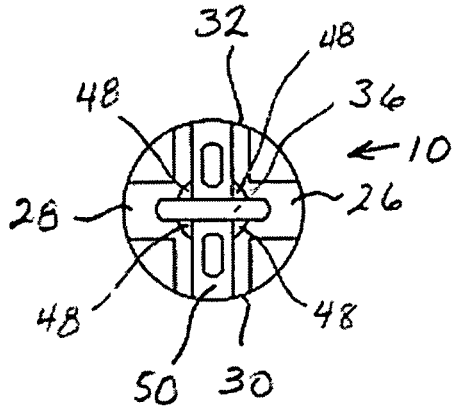
FIG. 4 is a top plan view of the distal end of the tool of the invention.

The opposite, distal end 14 of the tool 10 is shaped into a cruciform having a first set of mutually opposing cruciform arms 26 and 28 and a second set of mutually opposing cruciform arms 30 and 32, ninety degrees offset from the first set. The first set of cruciform arms 26, 28 is oriented at right angles relative to the second set of cruciform arms 30 and 32, as best illustrated in FIG. 4. The distal end 14 of the tool 10 is preferably formed in a cruciform shape so as to leave longitudinally elongated corner cavities 34 that not only reduce the amount of plastic need to form the tool 10, but also allow uniform cooling of the distal end 14 of the tool 10 in the mold during molding.

Figure 3:
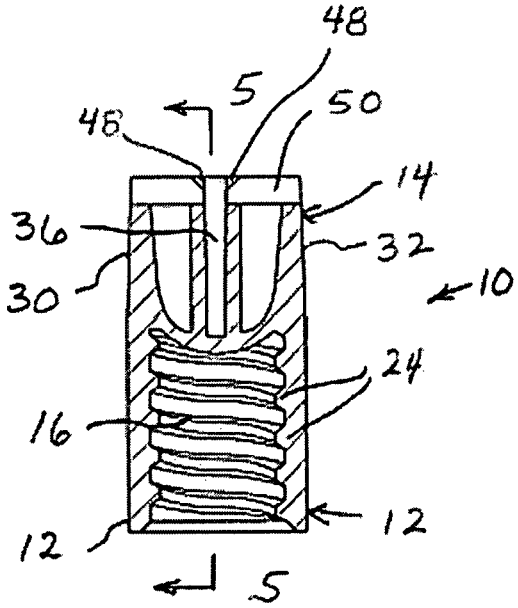
FIG. 3 is a sectional elevational detail of the tool of the invention taken along the line 3-3 in FIG. 1.

As illustrated in FIGS. 1, 3, and 4, a narrow, elongated slot 36 with a rectangular opening is formed in the structure of the cruciform arms 26 and 28 in the distal end 14 of the tool 10. The slot 36 is configured to receive the hook or crook portion 38 of a standard three-quarter inch cup hook 40 of the type illustrated, for example, in FIGS. 5 and 9. The cup hook 40 has a longitudinally extending shank 42 that is configured with external threads with a pointed tip 44 at its distal extremity. A rounded flange 46 is formed at the hook shoulder end of the shank 42, at the transition between the hook portion 38 and the cup hook shank 42. The flange 46 is curved convex toward the hook portion 38, and concave toward the cup hook shank 42. The flange 46 is configured generally as an arcuate segment of a sphere.

Figure 5:
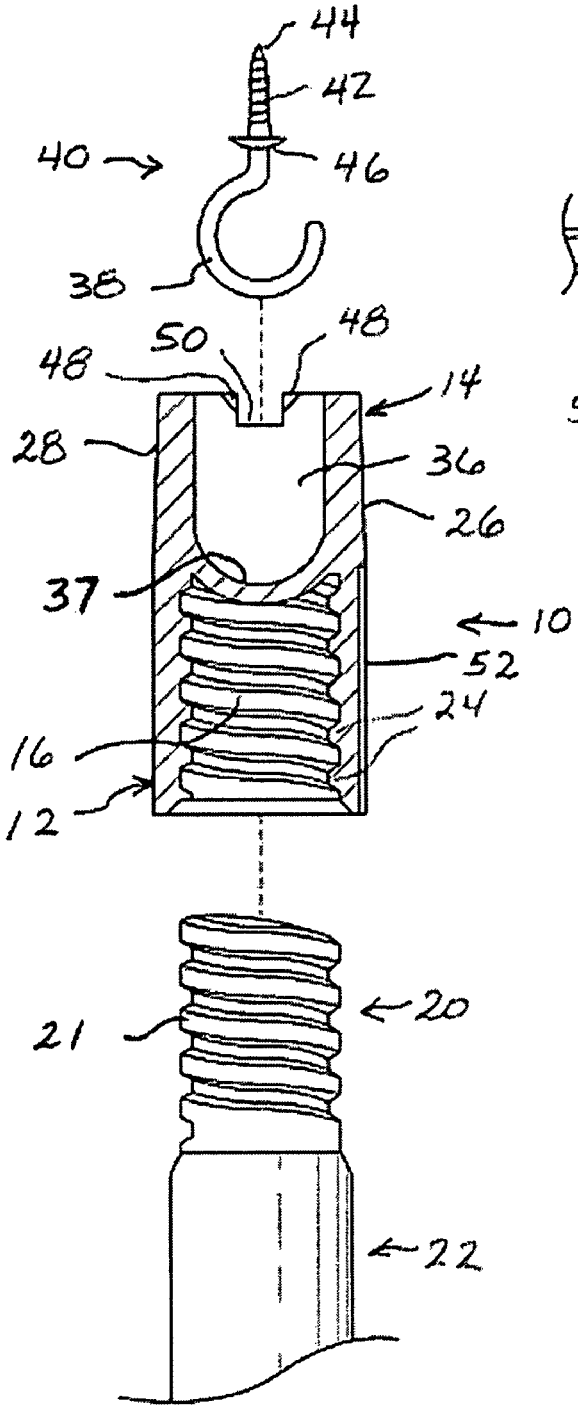
FIG. 5 is an exploded view taken along the lines 5-5 in FIG. 3 with the tool of the invention shown in section as used for installation and removal of a cup hook.

As viewed in FIG. 4, the hook receiving slot 36 is preferably 0.600 inches in length and 0.110 inches in width, and extends to a depth of 0.850 inches into the structure of the tool 10 from the longitudinal extremity of the distal end 14 thereof. As shown in FIG. 5, the slot 36 has a rounded bottom 37 with a concave curvature configured to receive and match the convex curvature of the depending crook portion 38 of the cup hook 40. At the longitudinal extremity of the distal end 14 the corners of cruciform arms 26, 28, 30, and 32 are chamfered, as indicated at 48, with a concave curvature corresponding to the mating convex curvature of the flange 46 of the cup hook 40.

The other pair of opposing cruciform arms 30 and 32 are both bifurcated by a transverse channel 50 that is preferably 0.210 inches in width, as viewed in FIG. 4, and 0.120 inches in depth, as viewed in FIG. 5. The channel 50 extends diametrically across the entire width of the distal end 14 of the tool 10 through the structure of the opposing arms 30 and 32, as illustrated in FIG. 1. In contrast, and as illustrated in that same drawing figure, the slot 36 is oriented perpendicular to the channel 50, but does not extend through the outboard ends of the arms 26 and 28.

Figure 2:
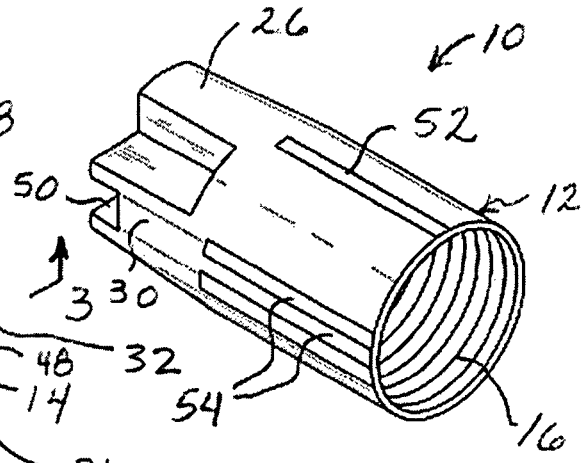
FIG. 2 is a perspective view of the tool of the invention as viewed from the proximal end thereof.

As illustrated in FIGS. 1 and 2, the tool 10 has a first indicia, which is a single longitudinal groove 52 defined in the outer side wall structure of its proximal end 12. The groove 52 is preferably about a sixteenth of an inch in width and resides in the same plane as the centers of the cruciform arms 26 and 28.

A second indicia in the form of a pair of mutually parallel grooves 54 is also formed in the outer wall structure of the proximal end 12 of the tool 10. The grooves 54 are angularly offset from the groove 52 by ninety degrees, so that the center ridge between the grooves 54 resides in coplanar relationship with the second set of cruciform arms 30 and 32.

To utilize the tool 10 to install and remove a series of cup hooks 40, the tool 10 is first oriented with its proximal end 12 facing the externally threaded tip 20 of a broomstick or other extension pole, as illustrated in FIG. 5. The threaded pole end 20 is then pushed into the socket 16 and the tool 10 is rotated in a clockwise direction relative to the broomstick 22, as viewed in FIG. 4, until the internal threads 24 within the socket 16 are firmly threadably engaged on the external threads 21 defined on the threaded tip 20 of the broomstick 22. The tool 10 is shown firmly but releaseably attached to the broomstick 22 in this manner in FIG. 9.

Figure 9:
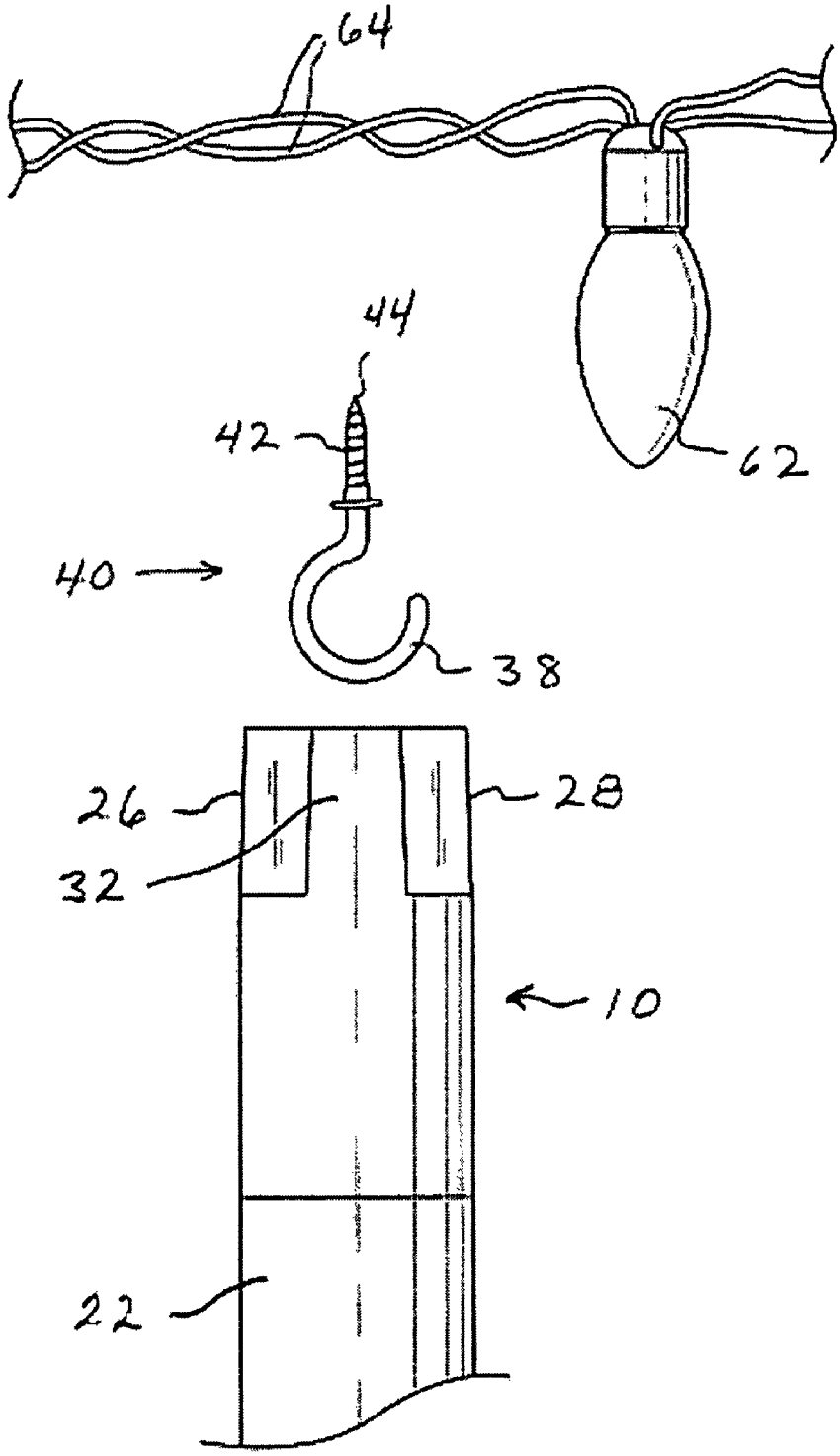
FIG. 9 is an elevational detail view illustrating use of the tool of the invention.

For installation of a series of cup hooks 40, each cup hook 40 is positioned in alignment with the broomstick 22 with the hook portion 38 thereof aligned in coplanar relationship relative to the hook receiving slot 36 in the distal end 14 of the tool 10, as illustrated in FIGS. 5 and 9. The cup hook 40 is then advanced toward the tool 10 so that the hook portion 38 of the cup hook 40 is pushed into and snugly received within the slot 36. Preferably, the convex extremity of the hook portion 38 resides in contract with the concave bottom 37 of the slot 36, while the convex face of the flange 46 resides in contact with the concave chamfered areas 48 at the inboard ends of the cruciform arms 26, 28, 30, and 32. With the hook portion 38 of the cup hook 40 seated within the hook receiving slot 36, the chamfered surfaces 48 bear against the edges of the cup hook base 46 so as to hold the cup hook shank 42 in coaxial alignment with both the tool 10 and the pole 22. A cup hook 40 is illustrated seated within the channel 36 and ready for attachment to an elevated box eave surface 56 of a building structure 58 in FIG. 6.

Figure 6:
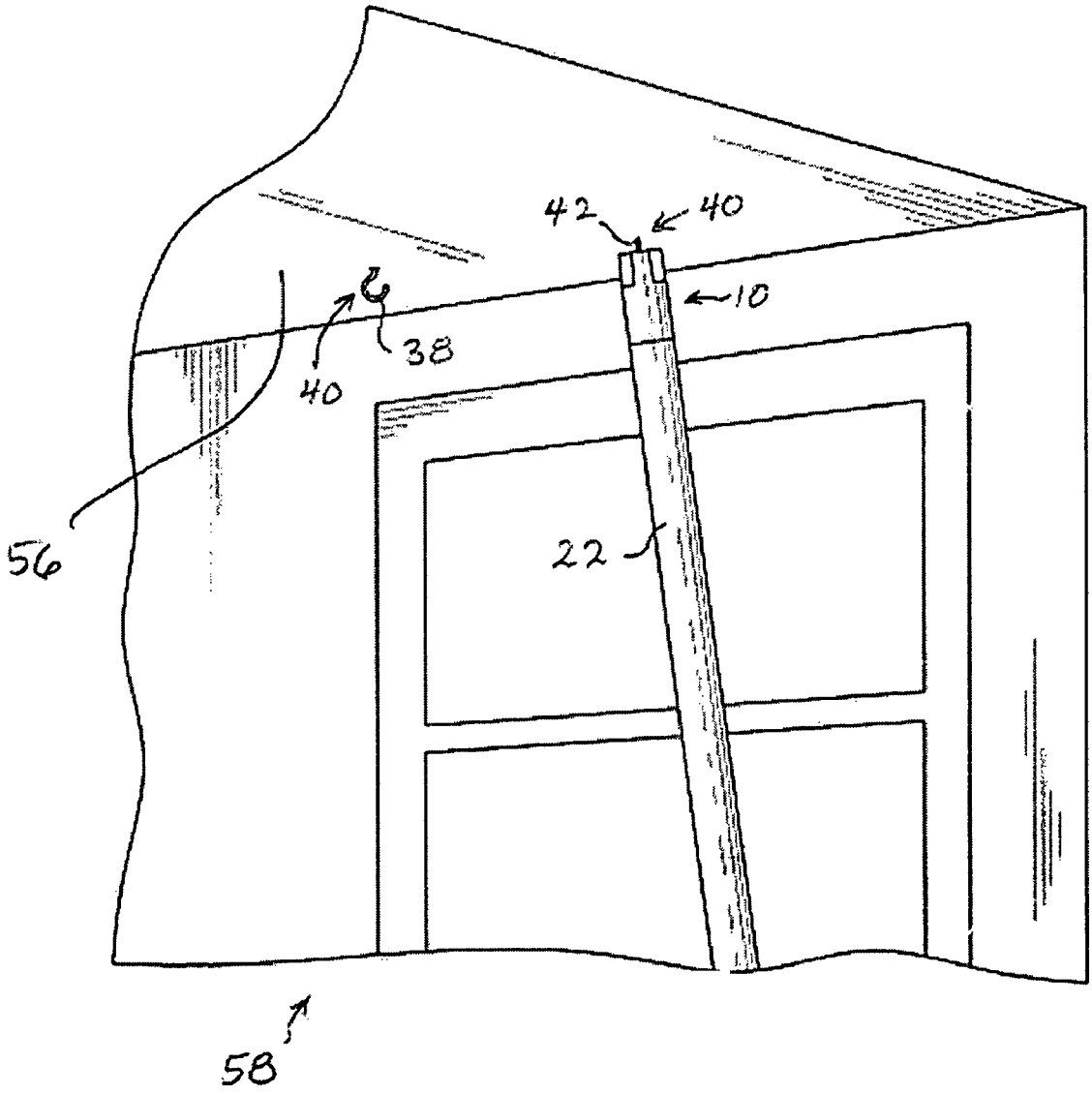
FIG. 6 is a perspective view illustrating installation and removal of cup hooks according to the method of the invention.

To install the cup hooks 40, the user merely stands on the ground vertically beneath the location at which the cup hook 40 is to be installed and raises the pole 22 to bring the pointed distal tip 44 of the cup hook shank 42 up against the horizontal surface 56. Once contact is made the installer rotates the pole 22 about its own axis in the conventional right hand screw thread direction to advance the threads on the shank 42 of the cup hook 40 into the wooden structure of the box eave 56. Once the shank 42 has been advanced until resistance is met by the flange 46 bearing against the horizontal surface 56, the cup hook 40 is fully installed. Typically, the installer will adjust the orientation of the cup hook so that the open hook portion 38 of the cup hook 40 faces outwardly away from the vertical wall of the building structure 58 so as to facilitate subsequent installation of the string of decorative lights 60. In FIG. 6 one of the cup hooks 40 is shown installed, while another cup hook 40 is shown ready for installation with its hook portion 38 still seated within the hook seating slot 36 of the tool 10 and with its externally threaded shank 42 projecting therefrom.

Figure 7:
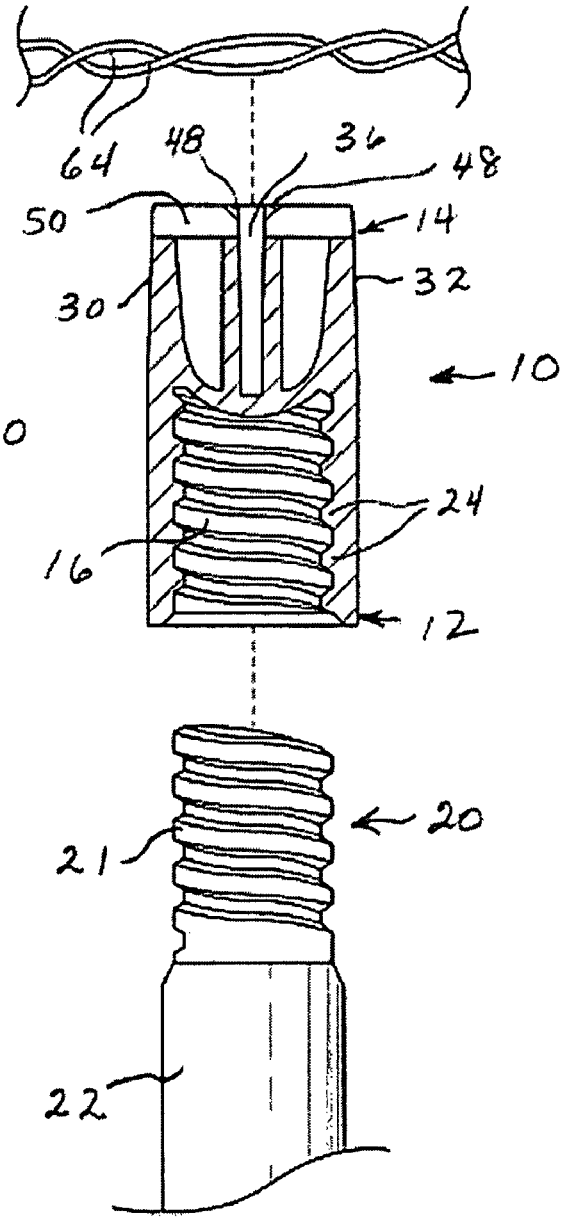
FIG. 7 is an exploded view, with the tool of the invention shown in section, taken along the line 3-3 in FIG. 1, showing use of the tool for putting up and taking down a string of decorative lights.
Figure 8:
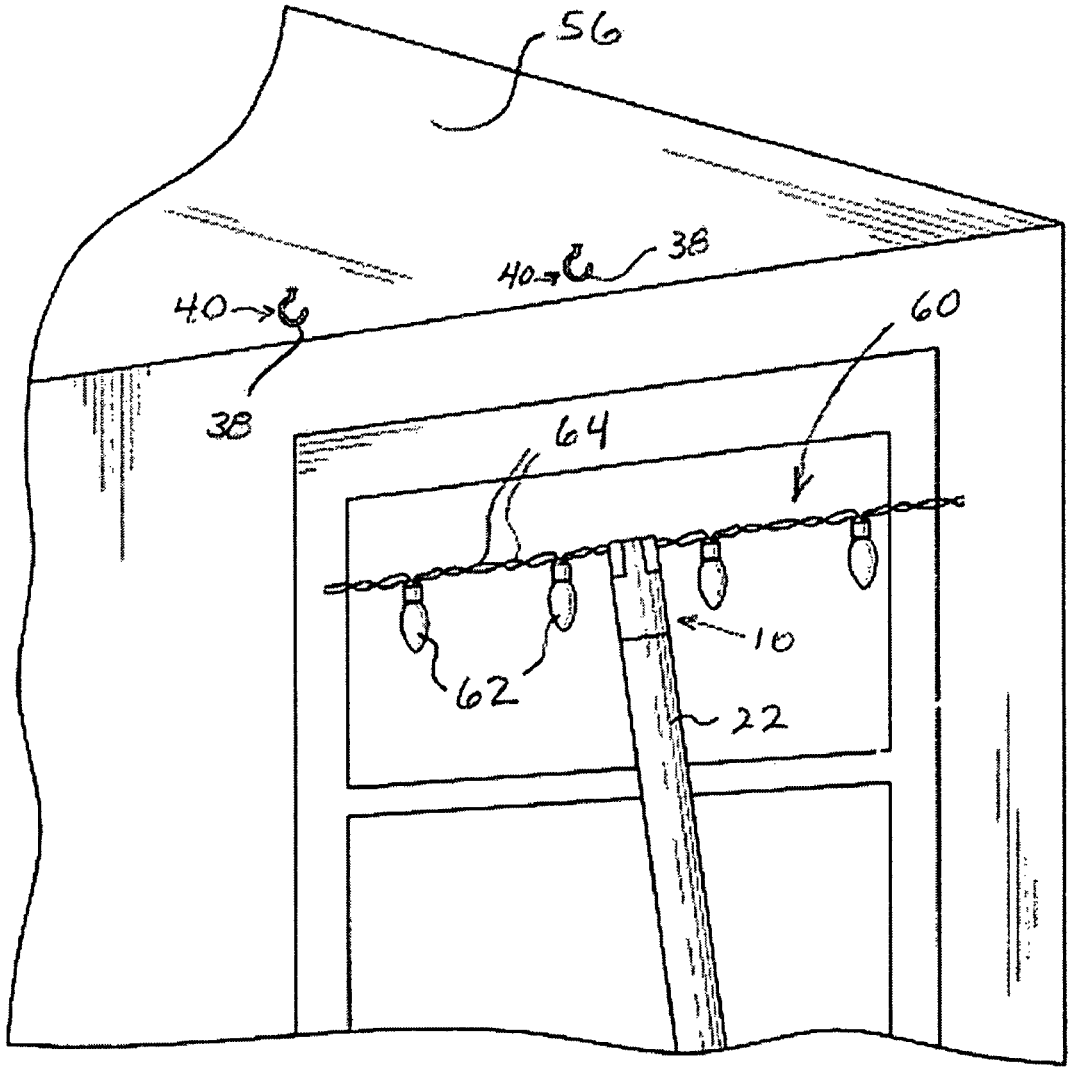
FIG. 8 illustrates use of the tool in installing and removing a string of decorative lights according to the method of the invention.

Once all of the cup hooks 40 have been installed in the downwardly facing surface 56 of the building structure 58, the light string 60 is thereafter installed, as illustrated in FIG. 8. The light string 60 is comprised of a multiplicity of electrical illuminating bulbs 62 joined together by a twisted pair of insulated electrical wires 64. To install the light string 60, the pole 22 is positioned so that the twisted pair of the wires 64 is seated in the channel 50 in the distal end 14 of the tool 10, as indicated in FIG. 7. The user drapes the light string 60 through the channel 50. Next, the user holds the loose end of the light string 60 with one hand and positions the twisted pair of wires of it into the channel 50, spaced far enough so that the tool 10 will be on the far side of the cup hook 40 relative to the immediately preceding cup hook 40.

The pole 22 is then raised, as illustrated in FIG. 8, and the twisted pair of wires 64 are lifted up to the next cup hook 40. The user then aligns the tool 10 next to a cup hook 40 to lay the wire in the crook of the cup hook 40. The wires of the light string 60 are then lowered through the openings in the hook portions 38 thereof so that the wires 64 are suspended from the hook portions 38 of all of the previously installed cup hooks 40.

The string of lights 60 and cup hooks 40 may be taken down in the reverse order. That is, to take down the string of lights 60 the pole 22 is raised with the channel 50 aligned and located directly beneath the wires 64 proximate a cup hook 40. Since it is difficult for the user to see the alignment of the channel 50 when the pole 22 is raised aloft, the user instead is able to use the grooves 54 to properly orient the tool 10 so that the electrical wires 64 reside in alignment with the channel 50 by sighting the tool 10 using the grooves 54 as indicators for the alignment of the cruciform arms 30 and 32 in which the channel 50 is formed.

With the channel 50 positioned directly beneath the wires 64, the pole 22 is raised slightly next one of the cup hooks 40, thus lifting the wires 64 out of the opening formed in the hook portion 38 of the cup hook 40 located immediately adjacent the pole 22. The user then proceeds from one cup hook 40 to the next, lifting the wires 64 out of each hook portion 38, one after the other.

Once the string of lights 60 has been removed from the cup hooks 40, the cup hooks 40 can either be left in position for subsequent reinstallation of light strings 60, or they can be removed. To remove the cup hooks 40, the reverse procedure from cup hook installation is followed. That is, the pole 22 is positioned so that the cup hook engaging slot 36 is aligned directly beneath and in coplanar alignment with the hook portion 38 of a cup hook 40. The pole 20 is thereupon raised, thereby engaging the hook portion 38 of the cup hook 40 in the hook receiving slot 36. The pole 22 is then counterrotated to unscrew the shank 42 of the cup hook 40 from the box eave surface 56. The frictional engagement of the threaded tip 20 of the pole 22 with the socket 16 is great enough so that the metal shank 42 will be threadably unscrewed while the socket 16 remains firmly engaged on the threaded tip 20 of the pole.

Undoubtedly, numerous variations and modifications of the invention will become apparent to those familiar with the installation and removal of decorative strings of lights and supports for those light strings from elevated structures. As such, while the present invention has been described with regards to particular embodiments, it is recognized that additional variations of the present invention may be devised without departing from the inventive concept.

INDUSTRIAL APPLICABILITY

This invention may be industrially applied to the development, manufacture, and use of devices that facilitate the installation of hooks and the hanging of light strings, such as strings of Christmas lights, from those hooks on the eaves of a roof or some other elevated structure.

What is claimed is:

1. An installation and removal tool for a string of lights and a cup hook, the tool comprising:

(a) a generally cylindrical body comprised of a molded, hard plastic, the body having a proximal end and a distal end;

(b) a threaded socket at the proximal end of the body, the threaded socket having a size and pitch to receive an externally threaded tip of an extension pole;

(c) a cruciform tip at the distal end of the body, the cruciform tip comprising an elongated slot in a first pair of opposing cruciform arms and a longitudinal channel in a second pair of opposing cruciform arms, the longitudinal channel being generally perpendicular to the elongated slot, and the cruciform tip having a chamfer where the longitudinal channel intersects the elongated slot;

(d) the elongated slot having a width, length, and depth of size just sufficient to snuggly receive a hook portion of a cup hook, the elongated slot having a narrow, elongated, rectangular opening, and a bottom of the elongated slot being rounded to conform to a rounded hook portion of the cup hook;

(e) the longitudinal channel extending diametrically across the distal end, intersecting the elongated slot, and being of a width just sufficient to snuggly receive a strand of twisted insulated wires of a light string;

(f) indicia on an external side surface of the body, the indicia comprising a single longitudinal groove in line with the elongated slot and a pair of mutually parallel grooves in line with the longitudinal channel, providing a visual aid to ascertain an angular orientation of the installation and removal tool;

(g) a plurality of longitudinally elongated corner cavities, each of the corner cavities being located between the first pair of opposing cruciform arms and the second pair of opposing cruciform arms at the distal end of the body; and (h) the body being connected to an end of an extension pole; wherein the tool facilitates installation or removal of the string of lights and cup hook on an elevated structure.

2. A tool for hanging and removing a light string and a mounting hook, the tool comprising:

(a) a body having a proximal end and a distal end;

(b) a socket at the proximal end of the body; and (c) a cruciform tip at the distal end of the body, the cruciform tip comprising an elongated slot in a first pair of opposing cruciform arms and a longitudinal channel in a second pair of opposing cruciform arms;

(d) the elongated slot having a width, length, and depth of size to receive a mounting hook;

(e) the longitudinal channel extending diametrically across the distal end, intersecting the elongated slot, and being of a width to receive the light string;

(f) a plurality of longitudinally elongated corner cavities, each of the corner cavities being located between the first pair of opposing cruciform arms and the second pair of opposing cruciform arms at the distal end of the body;

wherein the tool facilitates installation of removal of the light string and mounting hook on an elevated structure.

3. The tool of claim 2, the body being generally cylindrical.

4. The tool of claim 2, the body being comprised of a molded, hard plastic.

5. The tool of claim 2, the socket being internally threaded.

6. The tool of claim 5, the socket having a thread size and pitch to receive an externally threaded tip of a pole having a threaded end.

7. The tool of claim 2, the width, length, and depth of the elongated slot each being of a size to releasable receive a mounting hook.

8. The tool of claim 2, the longitudinal channel being generally perpendicular to the elongated slot.

9. The tool of claim 2, the cruciform tip being chamfered where the longitudinal channel intersects the elongated slot.

10. The tool of claim 2, the elongated slot having a narrow, elongated, rectangular opening, and a bottom of the elongated slot being rounded to conform to a rounded hook portion of a mounting hook.

11. The tool of claim 2, the width of the longitudinal channel being of a size to releaseably receive a strand of the light string.

12. The tool of claim 2, the tool further comprising indicia to provide a visual aid to ascertain an angular orientation of the tool.

13. The tool of claim 12, the indicia comprising a single longitudinal groove in line with the elongated slot and a pair of mutually parallel grooves in line with the longitudinal channel, the single longitudinal groove and the pair of mutually parallel grooves each being on a external surface of the body.

14. The tool of claim 2, the socket being connected to an end of an extension pole.

* * * * *